US006123574A

United States Patent [19]

Matsuda et al.

[11] Patent Number: 6,123,574

[45] Date of Patent: Sep. 26, 2000

[54] FEMALE CONNECTOR

[75] Inventors: Hirokazu Matsuda; Hajime Kawase, both of Yokkaichi, Japan

[73] Assignee: Sumitomo Wiring Systems, Ltd., Japan

[21] Appl. No.: 09/121,035

[22] Filed: Jul. 23, 1998

[30] Foreign Application Priority Data

Jul. 29, 1997 [JP] Japan ..... 9-203547

[51] Int. Cl.[7] ..... H01R 3/00

[52] U.S. Cl. ..... 439/488; 439/595

[58] Field of Search ..... 439/488, 595, 439/748, 940, 752.5, 744, 271

[56] References Cited

U.S. PATENT DOCUMENTS

| | | | |
|---|---|---|---|
| 4,557,542 | 12/1985 | Coller et al. | 439/595 |
| 5,256,083 | 10/1993 | Yamamoto | 439/595 |
| 5,503,570 | 4/1996 | Okada | 439/488 |
| 5,743,771 | 4/1998 | Yamaguchi et al. | 439/752.5 |
| 5,769,664 | 6/1998 | Saito et al. | 439/595 |
| 5,839,914 | 11/1998 | Watanabe et al. | 439/488 |

FOREIGN PATENT DOCUMENTS

| | | |
|---|---|---|
| 0 740 367 | 10/1996 | European Pat. Off. . |
| 36 33 358 | 4/1988 | Germany . |

*Primary Examiner*—Paula Bradley
*Assistant Examiner*—Alexander Gilman
*Attorney, Agent, or Firm*—Banner & Witcoff, Ltd.

[57] ABSTRACT

The interior of a connector housing 3 is provided with terminal housing chambers 11 to which female terminal fittings 2 can be attached. Wall faces 24 within the terminal housing chambers 11 protrude so as to cover only three sides, the wall face which constitutes the remaining side being formed by an insertion hole wall 23 of a retainer 4. Openings on the anterior face of the terminal housing chambers 11 are linked by bending spaces 14 which provide space for lances 12 to bend, the detecting holes 15 opening beside these bending spaces 14. When the retainer 4 is attached, bending regulation members 20 enclose the bending spaces 14 and partition tab insertion holes 11A and the detecting holes 15.

7 Claims, 4 Drawing Sheets

FEMALE CONNECTOR

TECHNICAL FIELD

The present invention relates to a female electrical connector.

BACKGROUND OF THE INVENTION

FIG. 7 of this specification shows a front view of a conventional female connector 100. On the anterior face of this female connector 100 there are tab insertion holes 101 which allow the insertion of corresponding male terminal fittings (not shown). Guiding faces 102 which guide the male tabs are provided on the edge of the holes. A part of the wall face of these guiding faces 102 is cut away to form conducting checking holes 103. Detecting pins (not shown) are inserted into these conducting checking holes 103 to confirm whether the female terminal fittings are correctly attached.

FIG. 8 shows a different type of conventional female connector 104. In this type of connector there are tab insertion holes 105 provided on the anterior face and detecting pins are inserted directly into resilient members of the terminal fittings (members which resiliently clamp the male tabs; not shown) in order to confirm whether the female terminal fittings are correctly attached.

However, when the female connector 100 shown in FIG. 7 is fitted together with a male connector, the anterior ends of the male tabs are sometimes accidentally caught in the conducting checking holes 103, these male tabs changing shape or distorting as a result.

Moreover, in the female connector 104 shown in FIG. 8, the detecting pins are inserted into the resilient members which are required to be resilient. As a result, the resilient members become bent and their resilience decreases, which is a problem.

The present invention has been developed after taking problems into consideration, and aims to present a female connector with openings in the anterior face for the detecting pins, and which does not affect the male and female terminal fittings.

SUMMARY OF THE INVENTION

According to the invention there is provided a female electrical connector comprising a female terminal fitting having a connecting member connectable to a male tab of a corresponding terminal fitting, and a protruding member protruding in a sideways direction from the connecting member; and a connector housing having a terminal housing chamber for housing the female terminal fitting, and a tab through hole opened out at the anterior face thereof, the tab through hole allowing the male tab to be passed therethrough, the female connector being characterised in that the anterior face of the connector housing has a detecting hole opened out therein for allowing the insertion of a detecting pin, the detecting pin detecting the correct attachment of the female terminal fitting by making contact with the protruding member, the detecting hole being connected to the terminal housing chamber, and being opened out at a location at a distance from the hole edge of the tab through hole.

The female connector may include a lance so as to protrude in the terminal housing chamber for maintaining the female terminal fitting in an unremovable position, the lance preferably being bendable due to a bending space provided near the terminal housing chamber, the bending space preferably opening out towards the anterior face of the connector housing. A retainer may be attached from the anterior face so as to close off the bending space, the retainer preferably comprising a bending regulation member which may be inserted into the bending space to regulate the bending of the lance and perform a secondary holding of the female terminal fitting.

The female connector may be formed with a guiding face on a portion of the hole edge of the detecting hole, the guiding face guiding the insertion of the detecting pin.

Preferably detecting holes are formed on the anterior face of a connector housing. The openings of these detecting holes, which allow the insertion of a detecting pin, are preferably formed at a distance from those of tab insertion holes which allow the insertion of a corresponding terminal fitting. As a result, male tabs cannot be mistakenly inserted into the detecting holes when a male terminal fitting is inserted into the tab insertion holes, and consequently there is no change in the shape of the tabs.

A terminal fitting may be secondarily stopped by a retainer, and the retainer closes off the openings of the bending spaces. As a result, the anterior ends of the male tabs cannot be caught in the open section of the bending spaces.

When a detecting pin is inserted into the detecting hole it is preferably guided by a guiding face. As a result, the guiding face can correct the position of the detecting pin when it is inserted, even if the position of the detecting pin is initially incorrect.

BRIEF DESCRIPTION OF DRAWINGS

An embodiment of the invention will now be described by way of example with reference to the accompanying drawings in which.

DESCRIPTION OF PREFERRED EMBODIMENT

Figure 1:
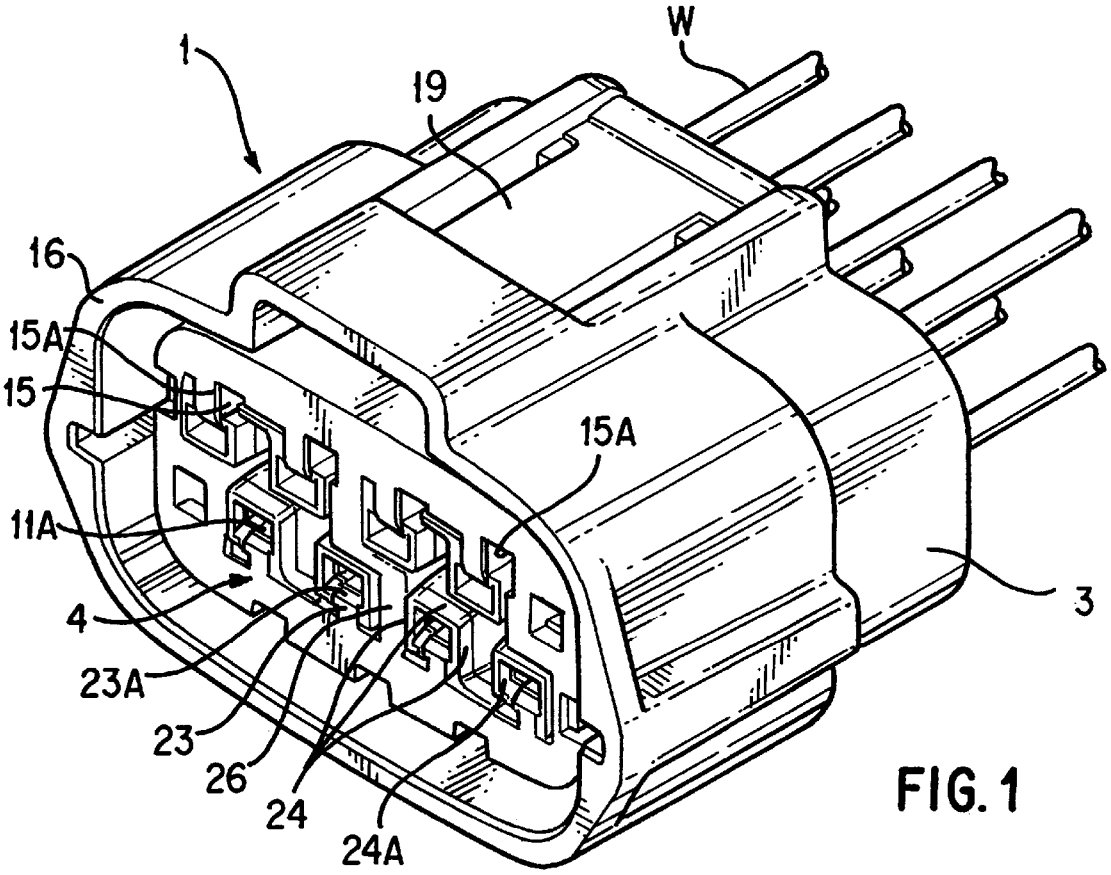
FIG. 1 is a perspective view of a female connector of the present embodiment.

FIG. 1 is a perspective view of a female connector 1 of the embodiment of the present invention. This female connector 1 is provided with female terminal fittings 2 (see FIGS. 2 and 6), a connector housing 3 to which the female terminal fittings 2 are attached, and a retainer 4 which prevents the removal of the terminal fittings 2.

Figure 2:
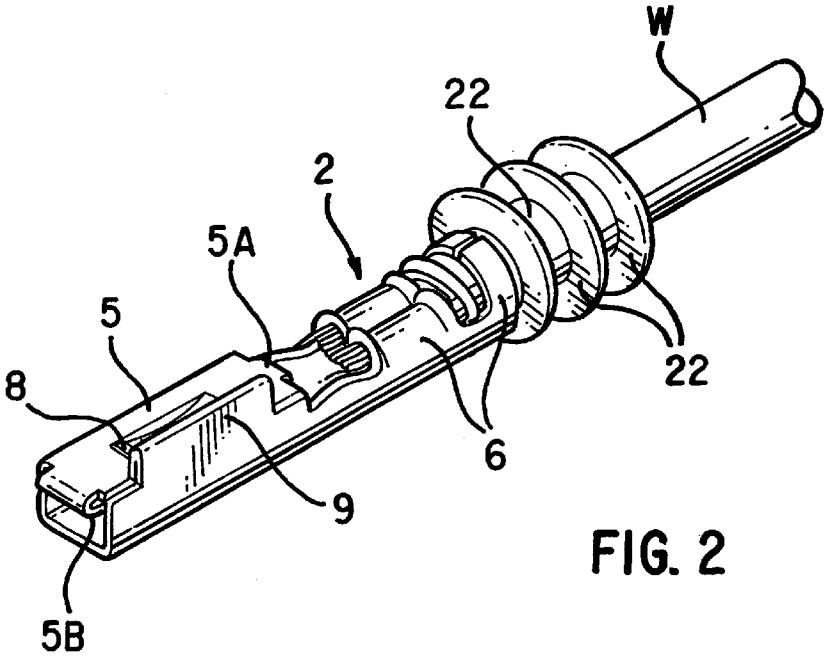
FIG. 2 is a perspective view of a terminal fitting.

As shown in FIG. 2, the terminal fitting 2 is made from an electrically conducting metal stamping which has been folded over. The anterior end thereof has a box shaped connecting member 5 to which male tabs (not shown) are connected. The posterior end thereof has a barrel member 6 to which an electric wire W is fixed. The anterior and posterior ends of the upper face of the connecting member 5 are bent over and inwards and form retaining edges 5B. Resilient members 7 fit with and are retained by these retaining edges 5B. The resilient members 7 form an inverted V shape cross-sectionally. Male tabs (not shown) are gripped between the highest point of the resilient member 7 and a face which faces it, the male and female terminal fittings being thereby linked together. Further, the central portion of the upper face of the connecting member 5 is cut away to form a spring strengthening member 8 which receives the resilient member 7 from its posterior face. The posterior end of the connecting member 5 forms a lance stop member 5A which acts as a preliminary stop in the connecting housing 3 to be retained by a lance 12 (to be described later). A protrusion 9 protrudes from the upper edge of one side face (the right side face in FIG. 2) of the terminal fitting 2. This protrusion 9 is located in approximately the central portion between the anterior and posterior ends of the connecting member 5 and is formed from a metal plate which protrudes upwards and has been bent back over in a downwards direction. Further, the anterior end portion of the electric wire W which is crimped by the barrel 6 is provided with a waterproof grommet 22. This waterproof grommet 22 is made from synthetic rubber and is cylindrical in shape. The internal diameter of the grommet 22 is approximately the same as the external diameter of the electric wire W, and three waterproof edges 22A protrude from its external periphery. The diameter of the grommet 22 is slightly larger than the diameter of a terminal attachment opening 11B and, when the terminal fitting 2 is installed within a terminal housing chamber 11, the terminal housing chamber is waterproofed.

Figure 4:
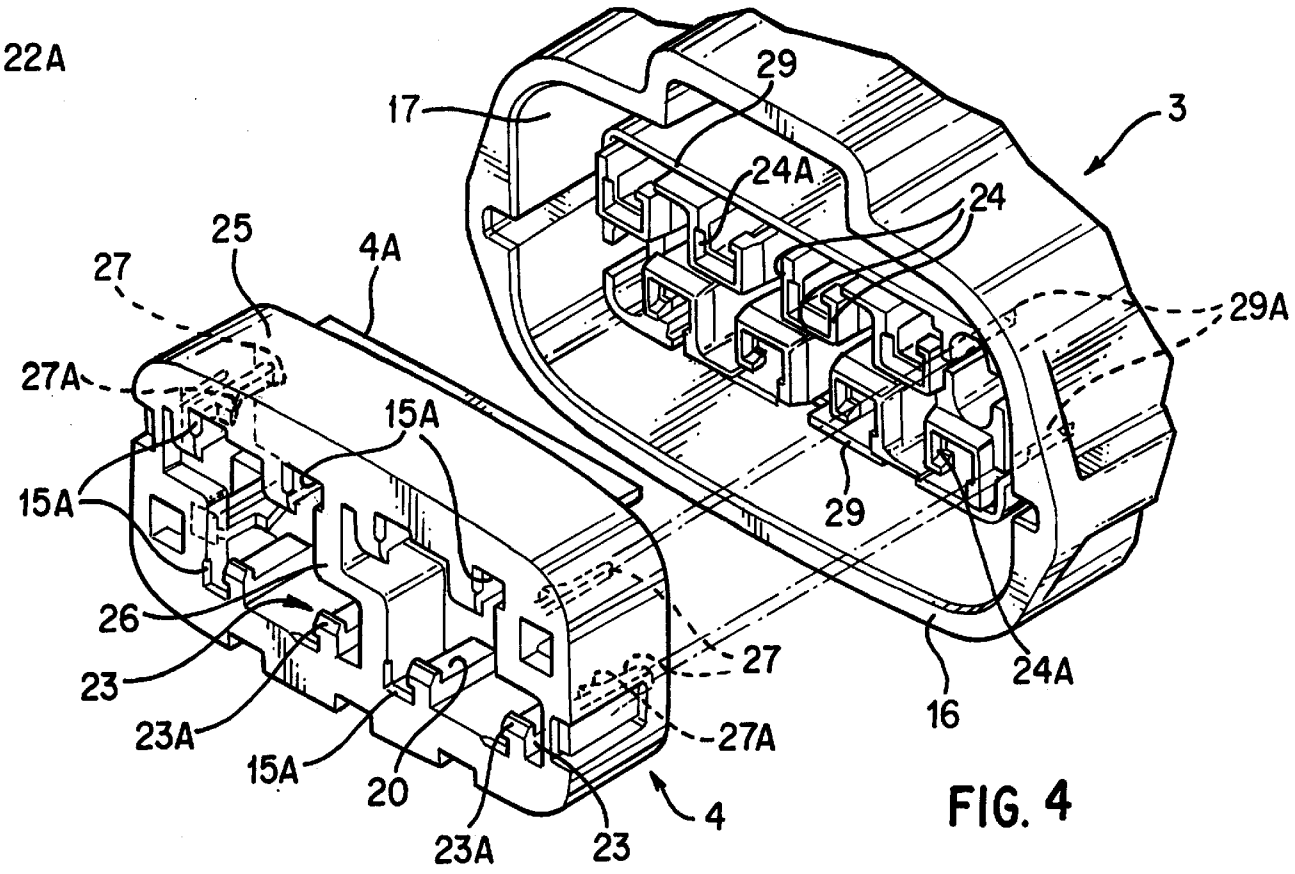
FIG. 4 is a partial perspective view of a retainer and part of a connector housing prior to being attached.
Figure 3:
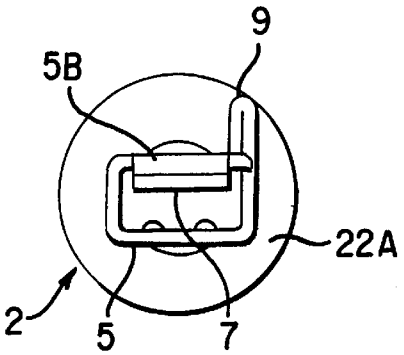
FIG. 3 is a face view of the terminal fitting.
Figure 5:
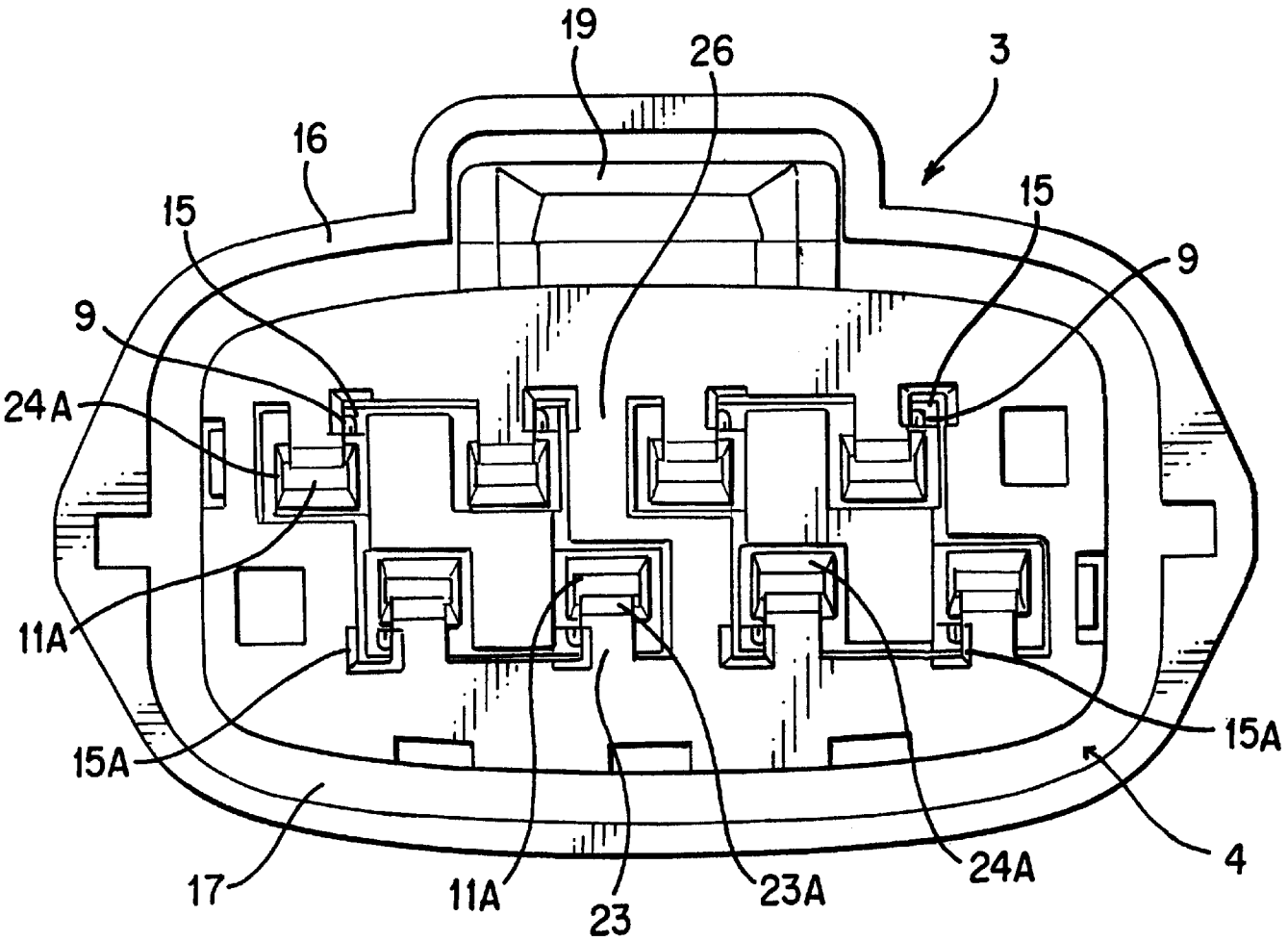
FIG. 5 is a face view of the female connector.

The connector housing 3 is formed in a unified manner from synthetic resin and contains terminal housing chambers 11 which house the terminal fittings 2. The terminal housing chambers 11 comprise an upper and lower row, and four columns from left to right. The exterior of these eight housing chambers 11 is surrounded by a surrounding wall 29 (see FIG. 4). The terminal housing chambers 11 are open at the anterior and posterior ends, the posterior being larger and forming the terminal attachment openings 11B, and the anterior face side being openings which form tab insertion holes 11A which allow the insertion of male tabs (not shown) of the corresponding terminal fittings, and which are adjacent to bending spaces 14 and detecting holes 15. (Moreover, these openings are partitioned, or enclosed, by the installation of a retainer, to be described later.) Of these openings, a portion of the wall face 24 forming the tab insertion holes 11A protrude outwards, this wall face 24 comprising three sides and one remaining side (the remaining side being the side closest to the surrounding wall 29). The remaining side is formed from an insertion hole wall 23 of the retainer 4. On the anterior end face of each wall face 24 there are guiding faces 24A for guiding the male tabs. Further, a lance 12 protrudes in an anterior direction from the farther portion of the remaining side mentioned above. The lance is engaged by the lance stopping member 5A of the terminal fitting 2, the lance 12 thereby providing a preliminary latch. In this way, since the lances 12 are formed on the side of the surrounding wall 29, the terminal fittings 2 are attached to the upper and lower rows of the terminal housing chambers 11 so that their lower faces (the face opposite to the face from which the protrusion 9 protrudes) face each other. Further, the bending spaces 14 are provided between the surrounding walls 29 and the lances 12 to allow the lances 12 to bend. The detecting holes 15 are formed in a portion located towards the surrounding wall 29 and away from the wall face 24 which forms the tab insertion holes 11A. The openings of the detecting holes 15 are smaller than those of the tab insertion holes 11A and are located so as to fit with the protrusions 9 of the terminal fittings 2. Moreover, a pair of upper and lower claw-like stopping members 29A are formed in the two side faces of the surrounding wall 29.

A hood 16 is formed on the connecting housing 3, this hood 16 protruding in the direction of the anterior face. A space of a specified distance between the hood 16 and the surrounding wall 29 constitutes a fitting space 17. A hood of a corresponding connector housing (not shown) is inserted into this fitting space 17. Moreover, the farther side of the fitting space 17 is provided with a waterproof member 18 which covers the surrounding wall 29. The waterproof member 18 is made from synthetic rubber and is of a schematically cylindrical shape. Both the external and internal sides of the cylindrical portion thereof are formed in a serpentine shape. When the waterproof member 18 is joined and fixed tightly to the surrounding wall 29 and the hood of the male connector housing, it maintains the fitting portions of the two connector housings in a waterproof state. In addition, on the upper portion of the connector housing 3 there is a cantilevered locking member 19 which prevents the removal of a corresponding connector housing.

The retainer 4, which provides secondary retention for the terminal fitting 2, is attached from the anterior face of the connector housing 3. The retainer 4 is made from synthetic resin and is of a schematically tubular shape with anterior and posterior openings. The retainer 4 can be retained in the connector housing 3 even if it is revolved by 180° in an up-down direction. When the retainer 4 is fitted so as to cover all the eight terminal housing chambers 11 from the external side of the surrounding wall 20, bending regulation members 29 protrude in a rectangular parallelepiped shape from an external wall 25 of the retainer 4, these bending regulation members 20 fitting with the bending spaces 14 of each terminal housing chamber 11. When the bending regulation members 20 are inserted into the bending spaces 14, they provide secondary retention for the terminal fitting 2 by regulating the bending of the lances 12. Insertion hole walls 23 protrude from the anterior edges of the bending regulation members 20. The insertion hole walls 23 are positioned at the open end of the tab insertion holes 11A (on the anterior face of which three sides form the wall face 24) of the connector housing 3. These insertion hole walls 23 join with the tab insertion holes 11A to form a square shape. Further, the anterior end portion of the insertion hole walls 23 has guiding faces 23A which guide the insertion of male tabs. When the bending regulation members 20 and insertion hole walls 23, formed as described above, are attached to a connector housing 3, the insertion hole walls 23 join with the tab insertion holes 11A to complete the connection of the four sides thereof, the bending spaces 14 are enclosed by the bending regulations member 20, and the bending spaces 14 and the detecting holes 15 are partitioned. Moreover, on the anterior face of the insertion hole walls 23 and the retained 4 there are guiding faces 15A which correspond to the location of hole edges of the detecting holes 15. When a detecting pin 30, to be described later, is inserted into the detecting hole 15, the guiding face 15A corrects positional faults of the detecting pin 30 and guides it into the detecting hole 15. In addition, in the central portion of the retainer 4 there is a strengthening member 26 which joins the external wall 25 above and below. The strengthening member 26 is formed so that its central portion is bent twice at right angles, thereby allowing it to avoid the tab insertion holes 11A located above and below. There are two retention protrusions 27 on each external wall 25 on the side faces of the retainer 4. These rotating protrusions 27 can bend outwards, and their anterior edges are provided with claw members 27A which protrude inwardly. Further, a pair of upper and lower guiding plate members 4A protrude from the posterior side of the retainer 4. These guiding plate members 4A are formed so as to match the height of the upper and lower faces of the surrounding wall 29.

Next, the operation and effects of the embodiment, configured as described above, will be explained.

The terminal fitting 2 is pushed into the terminal housing chamber 11 from the terminal attachment opening 11B. When it reaches a specified position, the lance 12 bends and is engaged by the lance stopping member 5A. At this point, the surrounding wall 29 is inserted and clamped between the pair of guiding plate members 4A of the retainer 4. When the claw members 27A of the stopping protrusions 27 retain the claw-shaped stopping members 29A, the retainer 4 and the connector housings 3 are unremovably interconnected, and the bending regulation members 20 enclose the openings of the bending spaces 14 and regulate the bending of the lance 12. This constitutes the secondary retention for the terminal fitting 2 inside the terminal housing chamber 11. Further, the insertion hole walls 23 fill in the open side of the tab insertion holes 11A so that the hole edges join to form a square shape. At this juncture, the detecting holes 15 are open and separated from the tab insertion holes 11A by a specified width.

Figure 6:
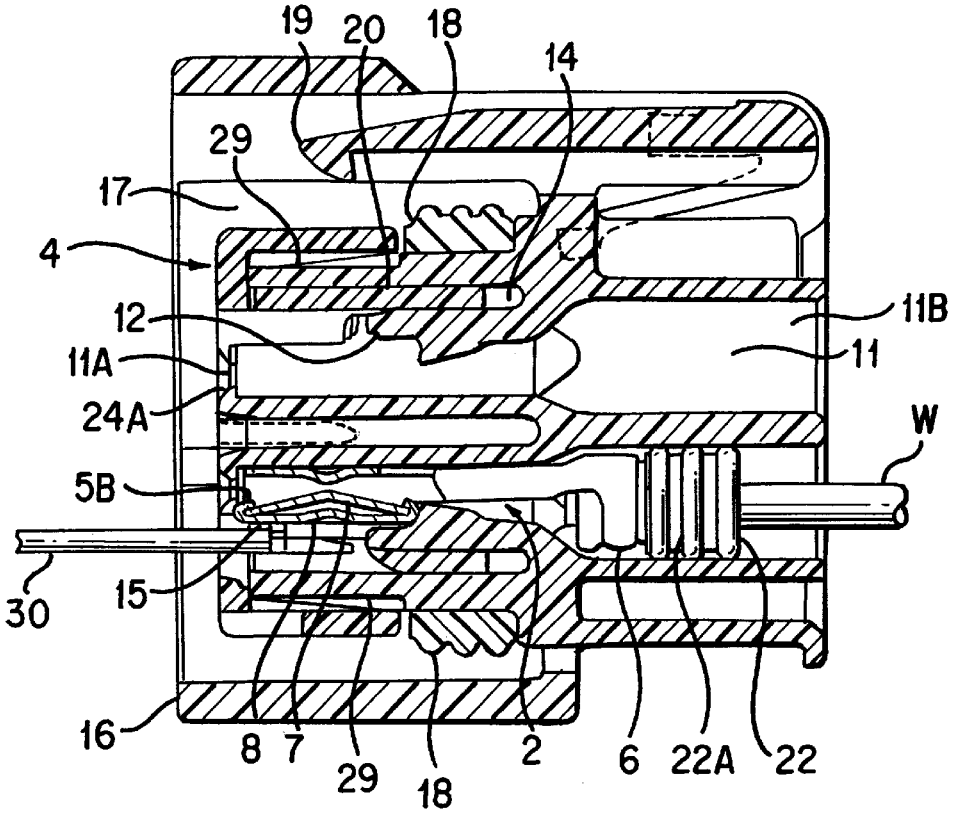
FIG. 6 is a side cross-sectional view of the female connector when a detecting pin is inserted.
Figure 7:
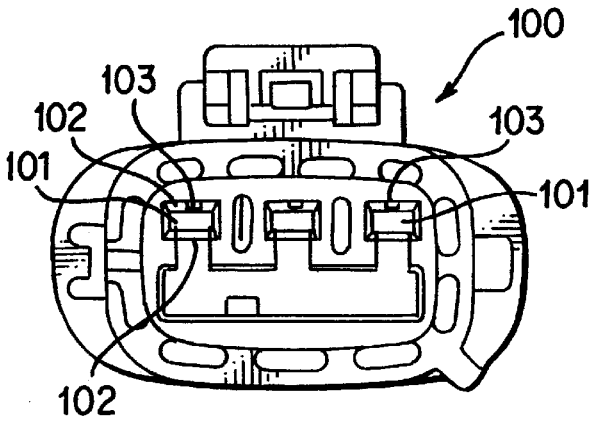
FIG. 7 PRIOR ART
FIG. 7 is a face view of a female connector of a conventional example.
Figure 8:
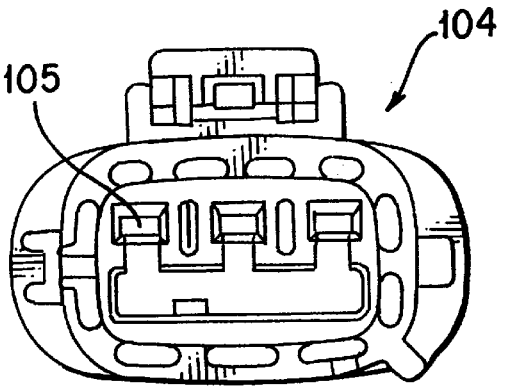
FIG. 8 PRIOR ART
FIG. 8 is a face view of a female connector of a conventional example.

When the female connector 1 has been fully inserted in this manner, the detecting pin 30 is used to ascertain whether the terminal fitting 2 has been attached (see FIG. 6). The detecting pin 30 is made from electrically conductive metal, and is connected to an electrical detection circuit (not shown). The detecting pin 30 is inserted from the detecting hole 15 and, when the anterior end of the detecting pin 30 makes contact with the protrusion 9 of the terminal fitting 2, the electrical detection circuit ascertains that the terminal fitting 2 has been attached. At this point, because there are guiding faces 15A on the hole edges of the detecting holes 15, the guiding faces 15A correct the position of the detecting pin 30 when it is inserted, even if the position of the detecting pin 30 is incorrect during the insertion.

According to the present embodiment, the tab insertion holes 11A which allow the insertion of the corresponding terminal fitting and the detecting holes 15 which allow the insertion of the detecting pin 30 are formed at separate locations on the anterior face of the connector housing 3. As a result, there is no possibility of the male tabs changing shape by being mistakenly inserted into the detecting holes 15 when the male terminal fitting is inserted into the tab insertion holes 11A.

Further, the terminal fitting 2 is secondarily retained by the retainer 4, and the retainer 4 encloses the open section of the bending spaces 14. As a result, the anterior ends of the male tabs cannot be caught in the open section of the bending spaces 14.

The present invention is not limited to the embodiments described above. For example, the possibilities described below also lie within the technical range of the present invention.

(1) The shape of the protrusions 9 may be different. The protrusions 9 may equally well protrude from the side of the terminal fitting 2.

(2) The retainer 4 may not be provided.

(3) The number of terminal housing chambers is not fixed at eight. There may equally well be a lesser or greater number of terminal housing chambers.

What is claimed is:

1. An electrical connector comprising:

a female terminal fitting with a connecting member connectable to a male tab of a corresponding terminal fitting, and a protruding member protruding in a lateral direction away from the connecting member; and a connector housing having an anterior face and a terminal housing chamber for housing the female terminal fitting, said anterior face including a tab through hole with a peripheral edge for allowing the male tab to be passed therethrough and couple to the connecting member, and a detecting hole in communication with the terminal housing chamber for allowing the insertion of a detecting pin for detecting the correct attachment of the female terminal fitting within the terminal housing chamber by making direct contact with the protruding member, the detecting hole being spaced along the anterior face from the peripheral edge of the tab through hole such that a partition is formed between the tab through hole and the detecting hole, and wherein a plane extending through said detecting hole is aligned with a side edge of said tab through hole along said anterior face.

2. A connector according to claim 1 wherein a guiding face is formed on a portion of an edge of the detecting hole for guiding the insertion of the detecting pin.

3. A connector according to claim 2 wherein said guiding face comprises a chamfer extending substantially around said detecting hole.

4. A connector according to claim 1 wherein said connecting member is rectangular in section, and said protruding member extends laterally away from said connecting member in a plane of one wall of said connecting member.

5. A connector according to claim 1 and further including a retainer attachable to the anterior face of said housing, said retainer retaining said terminal fitting against removal and partially defining the peripheral edge of said tab through hole.

6. A connector according to claim 1 and further including a retainer attachable to the anterior face of said housing, said retainer retaining said terminal fitting against removal and partially defining a peripheral edge of said detecting hole.

7. A connector comprising:

a female terminal fitting with a connecting member connectable to a male tab of a corresponding terminal fitting, and a protruding member protruding in a lateral direction away from the connecting member; and a connector housing having an anterior face and a terminal housing chamber for housing the female terminal fitting, said anterior face including a tab through hole with a peripheral edge for allowing the male tab to be passed therethrough and couple to the connecting member, and a detecting hole in communication with the terminal housing chamber for allowing the insertion of a detecting pin for detecting the correct attachment of the female terminal fitting within the terminal housing chamber by making direct contact with the protruding member, the detecting hole being spaced along the anterior face from the peripheral edge of the tab through hole such that a partition is formed between the tab through hole and the detecting hole, and further including a plurality of said tab through holes and detecting holes, wherein said tab through holes are adjacent each other, and said detecting holes are between a respective one of said tab through holes and a periphery of said housing, wherein said tab through holes are aligned in two parallel rows, said detecting holes are aligned in two rows parallel to said tab through hole rows.

* * * * *